US006886257B2

(12) United States Patent
Chih

(10) Patent No.: US 6,886,257 B2
(45) Date of Patent: May 3, 2005

(54) AUTOMATICALLY LOADABLE AND BLADE-STABILIZING UTILITY KNIFE

(76) Inventor: Gordon Chih, No. 33, Tien-Yang Lane, Chao-An Li, Lu-Kang Chen, Changhua Hsien (TW)

( * ) Notice: Subject to any disclaimer, the term of this patent is extended or adjusted under 35 U.S.C. 154(b) by 0 days.

(21) Appl. No.: 10/757,601

(22) Filed: Jan. 15, 2004

(65) Prior Publication Data

US 2005/0015996 A1 Jan. 27, 2005

(30) Foreign Application Priority Data

Jul. 23, 2003 (TW) ..... 92213482 U

(51) Int. Cl.[7] ..... B26B 1/08
(52) U.S. Cl. ..... 30/125; 30/162; 30/335
(58) Field of Search ..... 30/125, 162, 335

(56) References Cited

U.S. PATENT DOCUMENTS 3,872,591 A * 3/1975 Quenot ..... 30/162
4,005,525 A * 2/1977 Gringer ..... 30/125
4,517,741 A * 5/1985 Castelluzzo ..... 30/162
6,192,589 B1 * 2/2001 Martone et al. ..... 30/125
6,374,497 B1 * 4/2002 Sun ..... 30/162
6,446,340 B1 * 9/2002 Ping ..... 30/125
6,553,674 B1 * 4/2003 Budrow ..... 30/162
2004/0163261 A1 * 8/2004 Lin ..... 30/162

* cited by examiner

*Primary Examiner*—Hwei-Siu Payer
(74) *Attorney, Agent, or Firm*—Troxell Law Office, PLLC

(57) ABSTRACT

An automatically loadable and blade-stabilizing utility knife including a handheld housing, a slidable pushing mechanism, a resilient section, a releasing mechanism and a receptacle section. The housing has an open front end and an open rear end and serves to accommodate several blades therein. The pushing mechanism serves to engage with and push one of the blades. The resilient section serves to push the blades. The releasing mechanism serves to release the blade from the pushing mechanism. The receptacle section is disposed in the housing between the front and rear ends. The overlapping blades are loaded into the receptacle section through the opening of the rear end. Only one of the blades is permitted to slide between the front and rear ends. A pair of guide rails are disposed in the housing. A slide block is disposed on the pushing mechanism between the guide rails, whereby the blade can be more stably loaded and used.

2 Claims, 12 Drawing Sheets

AUTOMATICALLY LOADABLE AND BLADE-STABILIZING UTILITY KNIFE

BACKGROUND OF THE INVENTION

The present invention is related to a knife as a hand tool, and more particularly to an automatically loadable and blade-stabilizing utility knife.

The conventional utility knifes as hand tools have been developed by several stages.

The early utility knife has a housing composed of two substantially symmetrical casings locked together by screws. A blade is accommodated in the housing. The housing has an opening at front end and is equipped with a driving unit for pushing the blade to protrude from the front end and pulling the blade back into the housing. When the blade is worn out, a user must unscrew the screws to open the housing for changing the direction of the blade or replacing the blade. It is troublesome and apt to get hurt to replace the blade.

An improved utility knife has a hooking unit disposed between the two casings for easily opening the housing. However, a user still needs to change the direction of the blade or replace the blade with hands. Therefore, the user is still easy to get hurt when replacing the blade.

A further improved utility knife has a switch disposed at the front end of the housing. By means of rotating or pressing the switch, the blade can be extracted out of the housing to change the direction of the blade or replace the blade. Then the blade is inserted into the front end of the housing. With such structure, it is unnecessary to open the housing.

According to the above structures, only one blade is received in the housing. This is inconvenient in use. For example, in the case that no spare blade is available, it is impossible to further use the utility knife. In some utility knifes, a spare blade is placed in the housing. However, it is still necessary for a user to open the housing and replace the blade with hands.

Two kinds of advanced and automated utility knifes have been developed. Such utility knifes carry spare blades with themselves.

U.S. Pat. No. 5,604,984 discloses a first kind of utility knife carrying spare blade with itself. Such utility knife has a blade rest seat rotatable about a long axis of the housing. A series of blades are circumferentially arranged in the blade rest seat. The utility knife is designed with several switches for replacing the blades inside the housing. Such utility knife has some shortcomings as follows:

1. The structure of such utility knife is complicated. Also, it is troublesome and uneasy to operate such utility knife. In addition, the manufacturing cost for such utility knife is relatively high.
2. The spherical blade rest seat leads to enlarged handle of the utility knife. It is uneasy and uncomfortable to hold the handle.
3. Referring to FIGS. 1A and 1B, the blade used in such utility knife is not the one with standard commercial specification as shown in FIG. 1A. Instead, the blade used in such utility knife is a trapezoid one as shown in FIG. 1B. The angle contained between the bottom side and the lateral side of the blade is smaller than the standard specification so that the stress strength of such blade is less. Especially when cutting a caplet, the blade is very apt to break. Therefore, such utility knife is not popular after released.

FIGS. 2 to 4 show the second kind of utility knife carrying spare blade with itself. One side of the housing 91 is formed with a window 911. A cover 92 is pivotally latched in the window 911. Several overlapping blades 93 are transversely placed in the housing 91 through the window 911. In the case that the utility knife drops down, the cover 92 is apt to bound away and the blades 93 may slip out of the window 911. Furthermore, with such structure, a user can hardly pinch two plane faces of the blades 93 with fingers to load the blades 93. Instead, the user must pinch the sharp edges of the blades 93 to load the blades 93. Therefore, the fingers of the user are apt to be cut.

Moreover, after the blades 93 are placed into the housing 91, the blades 93 are uneasy to tidily overlap each other and snugly attach to a feeding unit 94 disposed in the housing. Therefore, the feeding unit 94 often fails to engage with the blade 93. This leads to malfunction of the utility knife.

On the other hand, the feeding unit 94 has an engaging block 941 for engaging with the blade. Two springs 942 are arranged on lateral sides of the engaging block 941 for pushing the engaging block 941 to engage in the notches 931 of the blade 93. The utility knife serving as a hand tool must be such designed that a user's hand can snugly hold the handle of the utility knife. Therefore, the housing 91 of the utility knife is fixed and thus the interior space of the housing 91 is limited. Accordingly, the two springs 942 are very small. It is uneasy to assemble so small components of the utility knife. In addition, once the springs 942 are bent or inclined, the engaging block 941 cannot effectively engage with the blade 93. This will lead to malfunction of the utility knife. Furthermore, when feeding the blade 93 to protrude from the front end of the housing 91, the blade 93 is simply engaged with the engaging block 941 without any other design for stabilizing the blade 93. Therefore, the blade 93 can be hardly smoothly fed. In addition, the blade 93 is hung on the movable feeding unit 94. A gap must exist between the feeding unit 94 and the housing 91 for easily moving the feeding unit 94. As a result, the structure is unstable and when using the utility knife, the blade 93 is apt to swing.

SUMMARY OF THE INVENTION

It is therefore a primary object of the present invention to provide a knife. The blades can be easily, truly and safely loaded into the housing of the knife.

It is a further object of the present invention to provide the above knife in which the blade can be more smoothly pushed and more reliably used.

It is still a further object of the present invention to provide the above knife which has simple structure and components for easily truly engaging with the blade.

It is still a further object of the present invention to provide the above knife which can be easily and firmly assembled to lower the manufacturing cost.

According to the above objects, the automatically loadable and blade-stabilizing utility knife includes a handheld housing, a slidable pushing mechanism, a resilient section, a releasing mechanism and a receptacle section. The housing has an open front end and an open rear end. The receptacle section is disposed in the housing between the front and rear ends. A pair of guide rails are disposed in the housing. A slide block is disposed on the pushing mechanism between the guide rails, whereby the blade can be more stably loaded and used.

The present invention can be best understood through the following description and accompanying drawings wherein:

DETAILED DESCRIPTION OF THE PREFERRED EMBODIMENTS

Figure 1B:
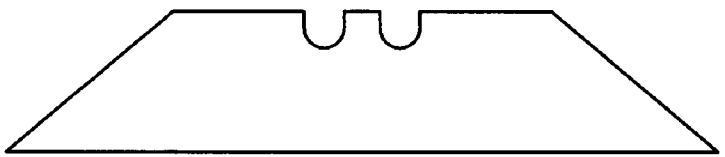
Fig. 1 B PRIOR ART
FIG. 1B is a front view of a blade of a conventional utility knife with specific size.
Figure 1A:
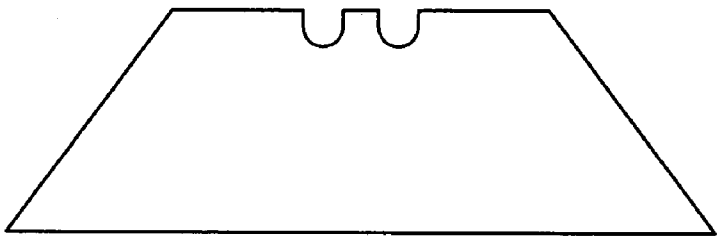
Fig. 1 A PRIOR ART
FIG. 1A is a front view of a blade of a conventional utility knife with standard size.
Figure 2:
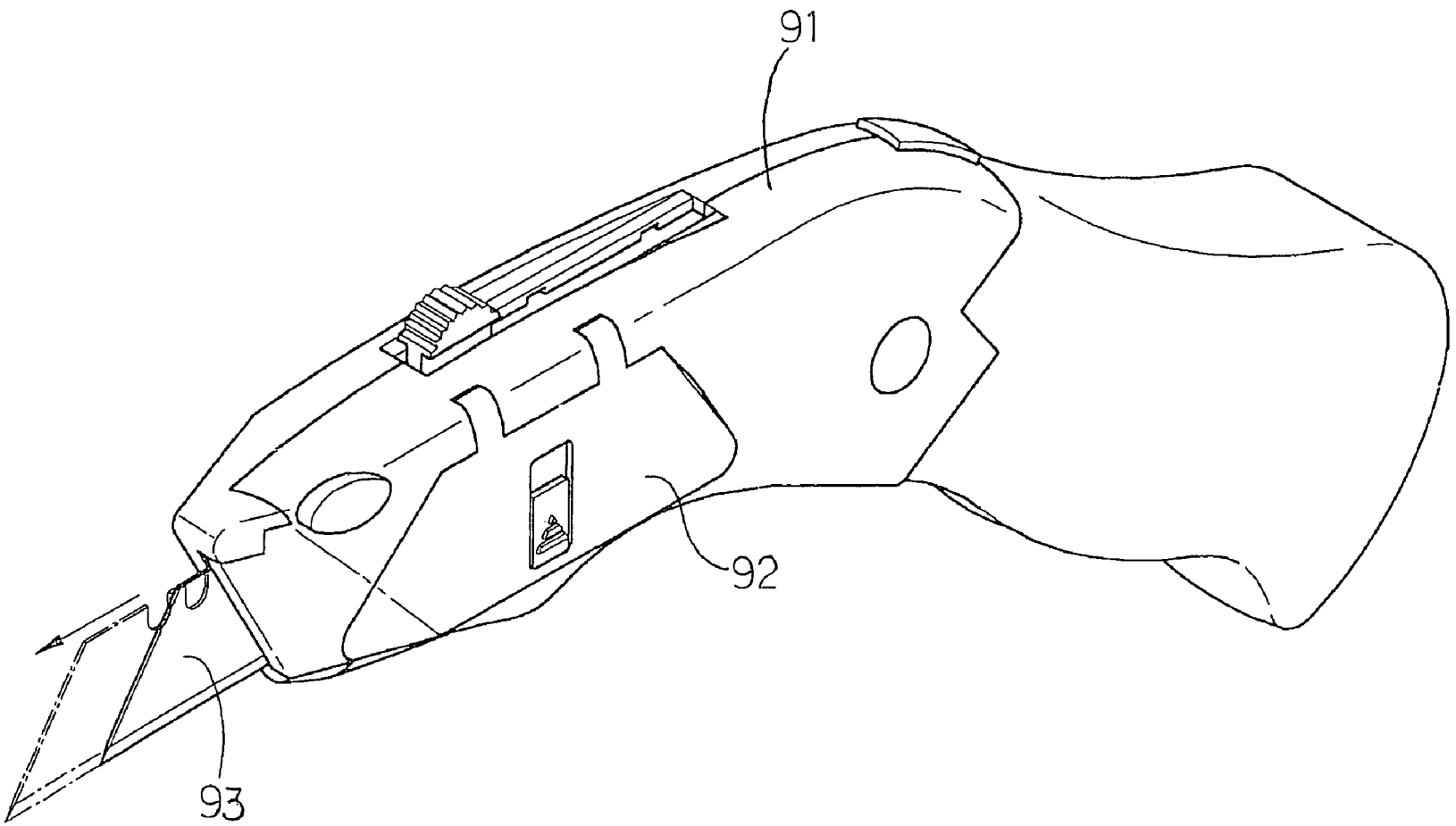
Fig. 2 PRIOR ART
FIG. 2 is a perspective assembled view of a conventional utility knife.
Figure 3:
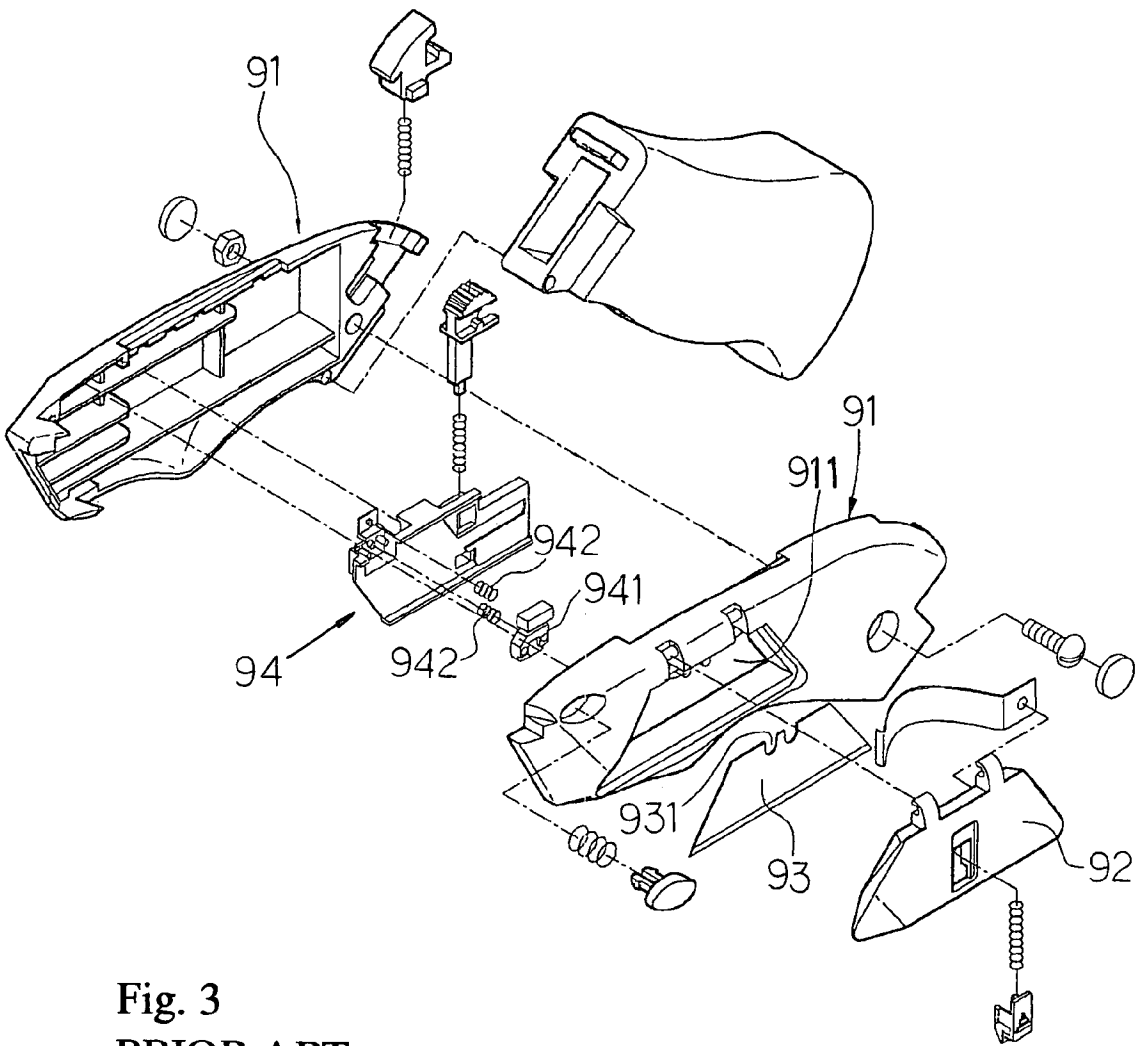
Fig. 3 PRIOR ART
FIG. 3 is a perspective exploded view of a conventional utility knife.
Figure 4:
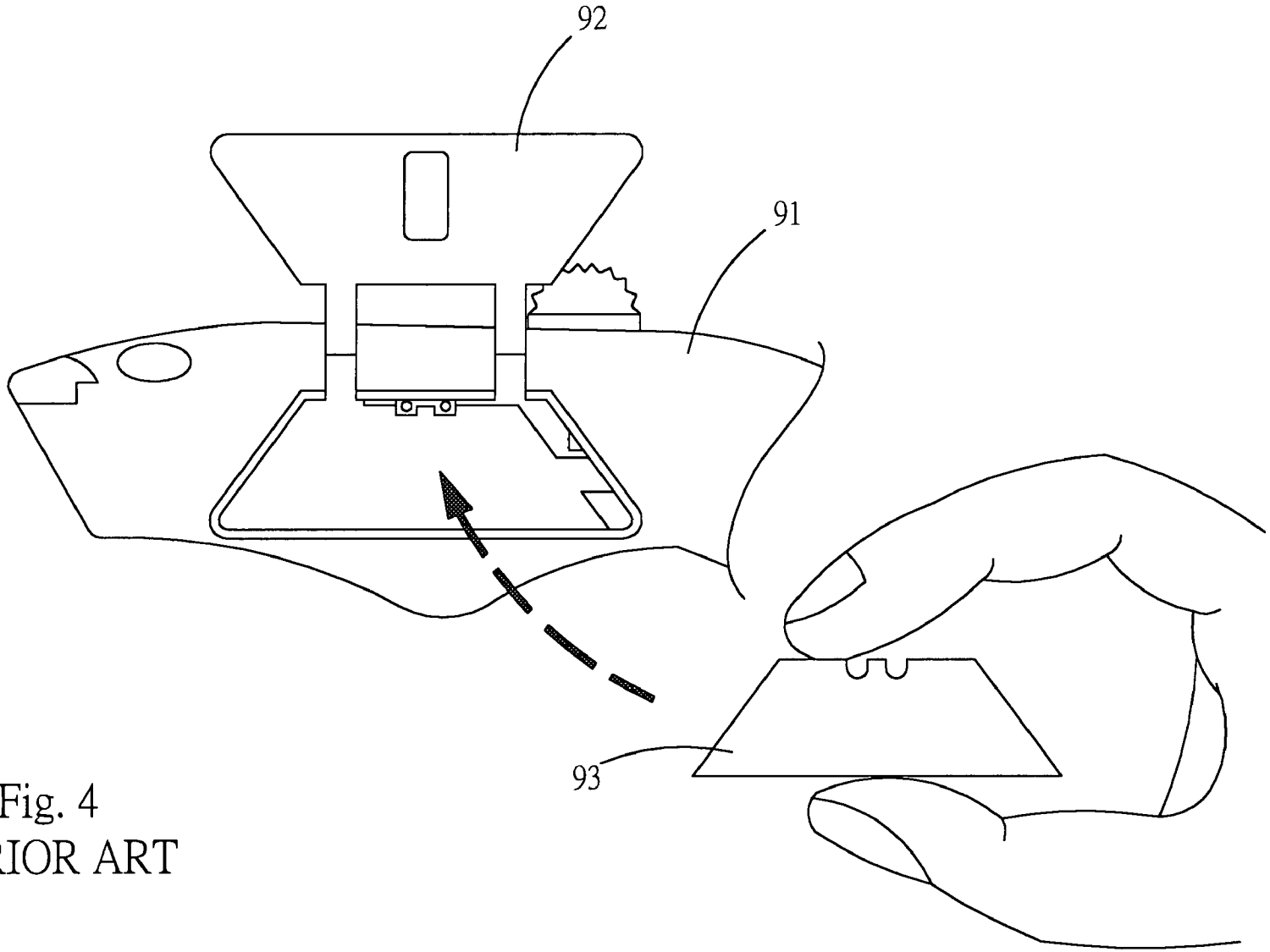
Fig. 4 PRIOR ART
FIG. 4 is a front view of the conventional utility knife in which overlapping blades are loaded.

Please refer to FIGS. 5 to 13. The automatically loadable and blade-stabilizing utility knife 1 of the present invention includes a handheld housing 11, a slidable pushing mechanism 12, a resilient section 13, a releasing mechanism 14 and a receptacle section 15.

The housing 11 has a front end 111 and a rear end 112. Several blades 113 can be accommodated in the housing 11. Each blade 113 has a notched section 113'. Each of the front and rear ends 111, 112 has an opening. The blades 113 are loaded into the housing through the opening of the rear end 112. A restricting section 114 such as a leaf spring is disposed at the rear end 112 for preventing the blades 113 from slipping out of the rear end 112.

The pushing mechanism 12 is disposed on the housing 11, including an activating section 22 and a moving section 24.

The activating section 22 outward protrudes from the housing 11 and is manually movable between the front end 111 and the rear end 112. In addition, the activating section 22 can be manually engaged with the housing 11, whereby the pushing mechanism 12 can be fixed in a first position or a second position of the housing 11.

The moving section 24 is connected with the activating section 22 and positioned inside the housing 11. When the pushing mechanism 12 is positioned in the first position, the moving section 24 is adjacent to the blades 113 for engaging with and pushing one of the blades 113 to the second position and protruding the blade from the front end 111 through the opening thereof.

The resilient section 13 is disposed on inner side of the housing 11. When the pushing mechanism 12 is positioned in the first position, the resilient section 13 serves to transversely push the blades 113 toward the moving section 24.

The releasing mechanism 14 is transversely reciprocally movably disposed on the housing 11. When the pushing mechanism 12 is positioned in the second position, the releasing mechanism 14 serves to push the moving section 24 to release the blade from the moving section 24. At this time, the blade can be pulled out from the opening of the front end 111.

The receptacle section 15 is formed of two channels 151 having a certain length in the lengthwise direction of the housing 11. The channels 151 are spaced from the front end 111 and rear end 112 by a certain distance and fixedly disposed in the housing 11. A partitioning body 52 is disposed between a middle portion of the receptacle section 15 and the front end 111 for partitioning the receptacle section 15 into a first space 54 and a second space 56. A distance between the inner sides of the bottoms of the channels 151 corresponds to the width of the blades 113. The overlapping blades 113 are loaded through the opening of the rear end 112 into the first space 54. Only one of the blades is permitted to pass through the second space 56 and protrude from the opening of the front end 111.

The present invention further includes a first latch section 116, a cover body 16 and a second latch section 62. The first latch section 116 is disposed at the rear end 112. One end of the cover body 16 is pivotally connected with the rear end 112. The second latch section 62 is disposed at the other end of the cover body 16. The first and second latch sections 116, 62 can be latched with each other for blocking/unblocking the opening of the rear end 112 of the housing 11.

In addition, the pushing mechanism 12 is further designed as follows:

A pair of guide rails 115 spaced from each other by a certain distance are disposed in the housing 11 between the front end 111 and the rear end 112. A slide block 26 is disposed on the moving section 24.

The guide rail 115 has a transverse bent section 115' between the first and second positions of the housing 11. The bent section 115' is obliquely bent toward the resilient section 13.

The slide block 26 is transversely slidably disposed on the moving section 24 and positioned between the guide rails 115. The slide block 26 has a sliding section 261 and an insertion section 262.

The sliding section 261 is disposed on two opposite sides of the slide block 26 for abutting against the guide rails 115. After the slide block 26 passes through the bent section 115', the slide block 26 is displaced in a transverse direction of the housing 11.

The insertion section 262 is disposed on the slide block 26 corresponding to the notched section 113'. When the slide block 26 is displaced, the insertion section 262 can be inserted into the notched section 113' by different depths for engaging with one of the blades. In other words, when the pushing mechanism 12 is positioned in the first position, the depth by which the insertion section 262 is inserted in the notched section 113' is not larger than the thickness of one blade. Therefore, the moving section 24 can only push one blade 113. After the slide block 26 moves forward toward the front end 111 and passes through the bent section 115', the slide block 26 is biased to make the insertion section 262 inserted in the notched section 113' by a larger depth which is even larger than the thickness of one blade 113. This makes the slide block 26 more firmly engaged with the blade so that the utility knife can be more reliably used.

Figure 5:
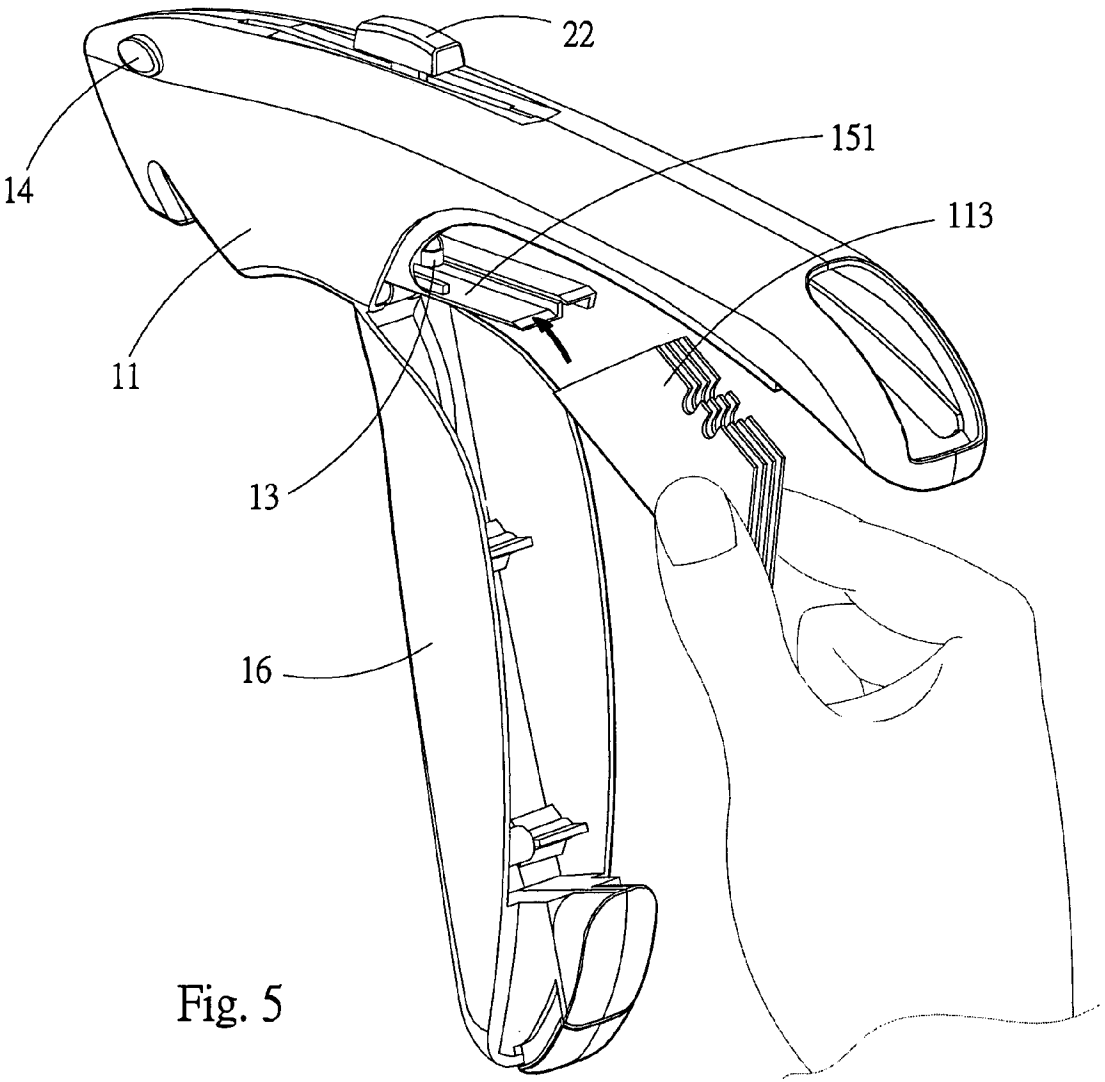
FIG. 5 is a perspective view of the utility knife of the present invention in which overlapping blades are loaded.
Figure 6:
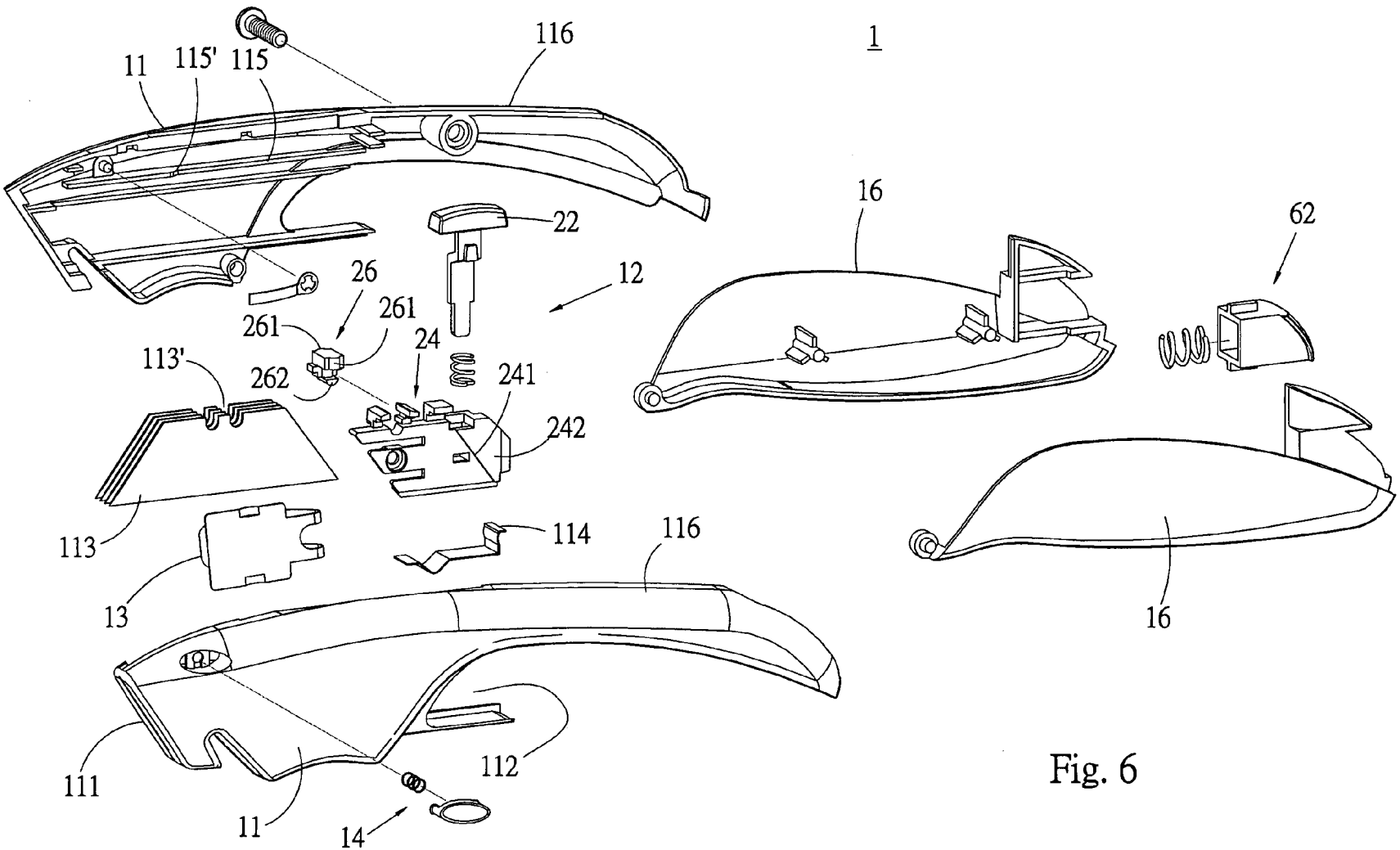
FIG. 6 is a perspective exploded view of the utility knife of the present invention.
Figure 7:
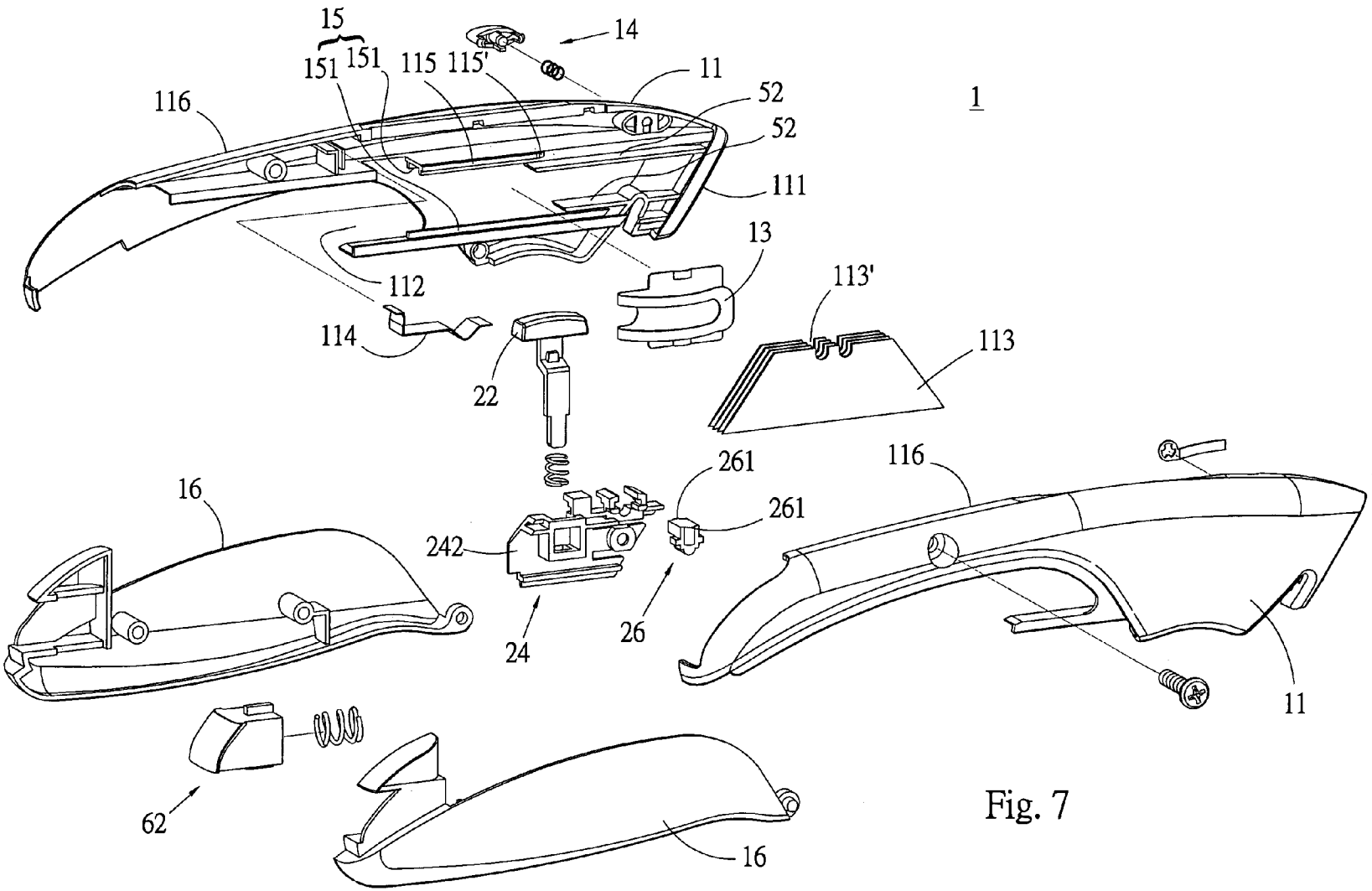
FIG. 7 is a perspective exploded view of the utility knife of the present invention, seen in another direction.
Figure 9:
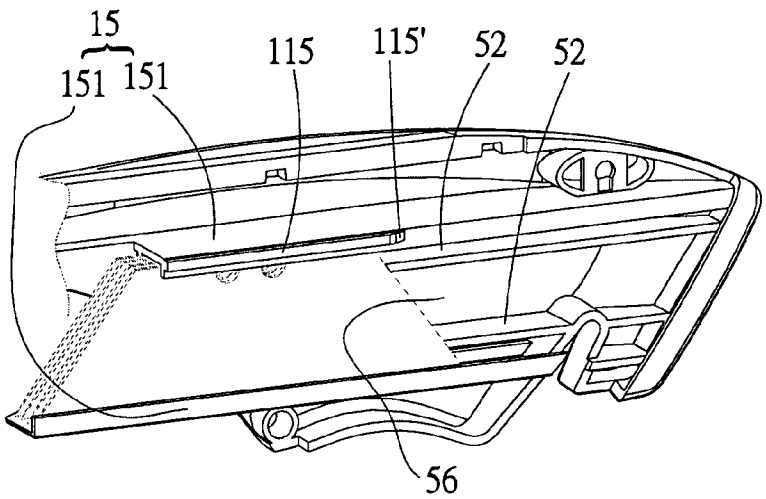
FIG. 9 is a perspective according to FIG. 8, in which several blades are accommodated in the receptacle section.
Figure 8:
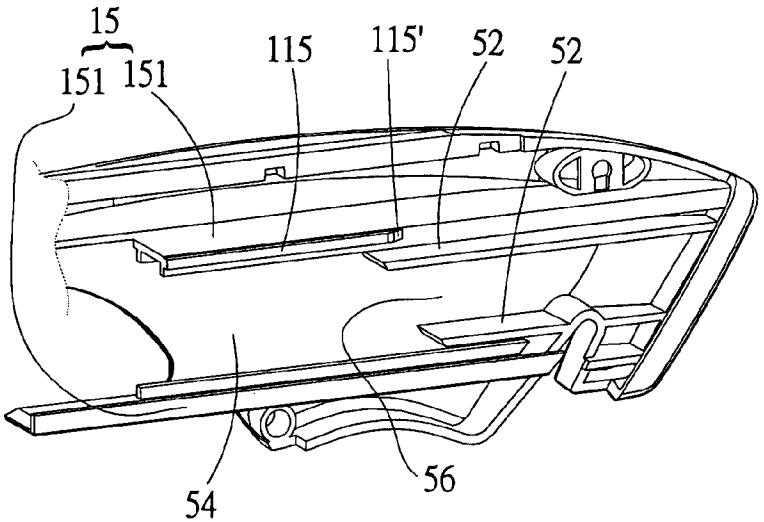
FIG. 8 is a perspective view showing the interior receptacle section of the housing of the utility knife of the present invention.
Figure 10B:
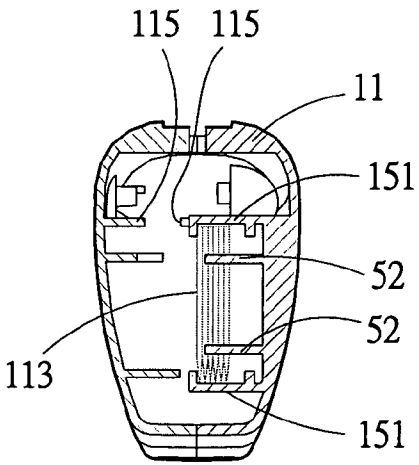
FIG. 10B is a sectional view taken along line I—I of FIG. 10A.
Figure 10A:
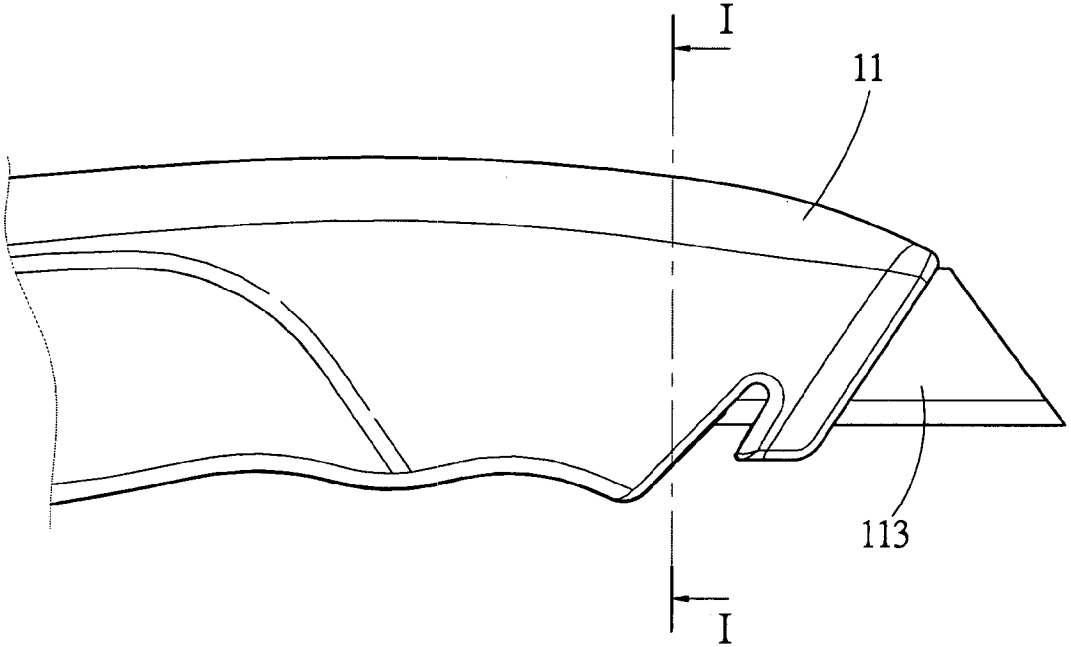
FIG. 10A is a side view of the housing in which the blades are loaded.
Figure 11A:
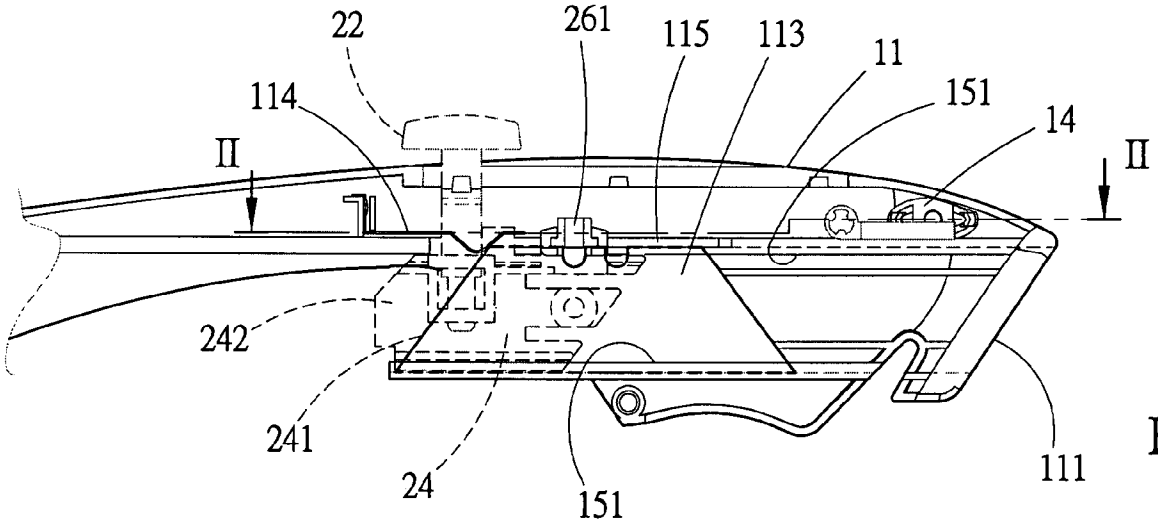
FIG. 11A is a front assembled view according to FIG. 5.
Figure 11B:
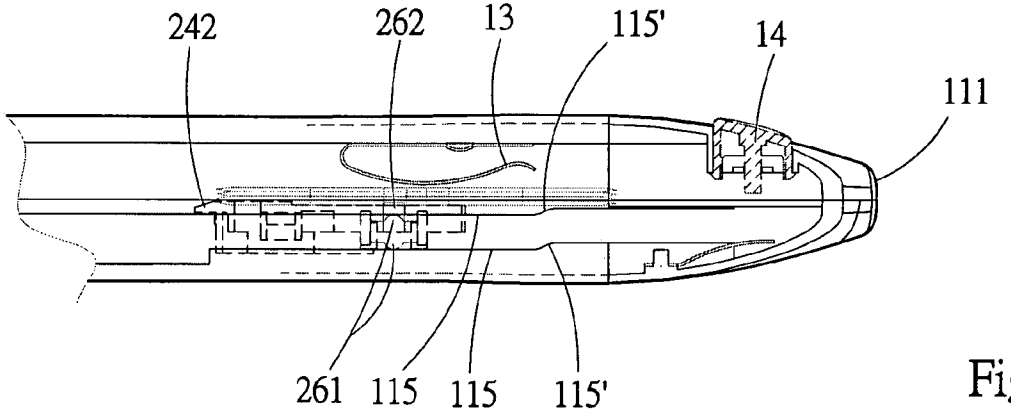
FIG. 11B is a top sectional view taken along line II—II of FIG. 11A, showing that the pushing mechanism of the present invention is positioned in the first position.
Figure 12A:
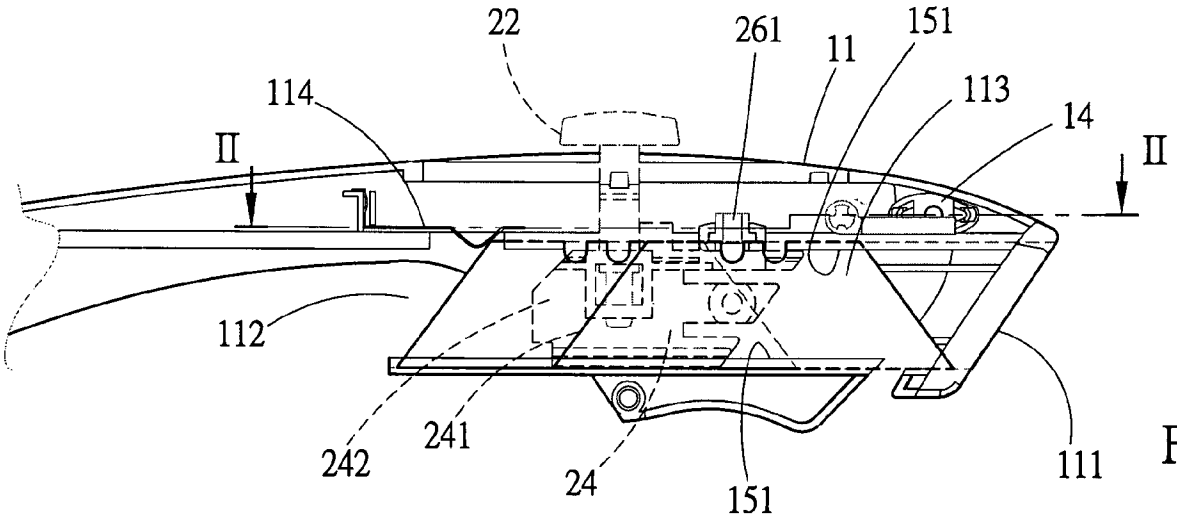
FIG. 12A is a front assembled view according to FIG. 5.
Figure 12B:
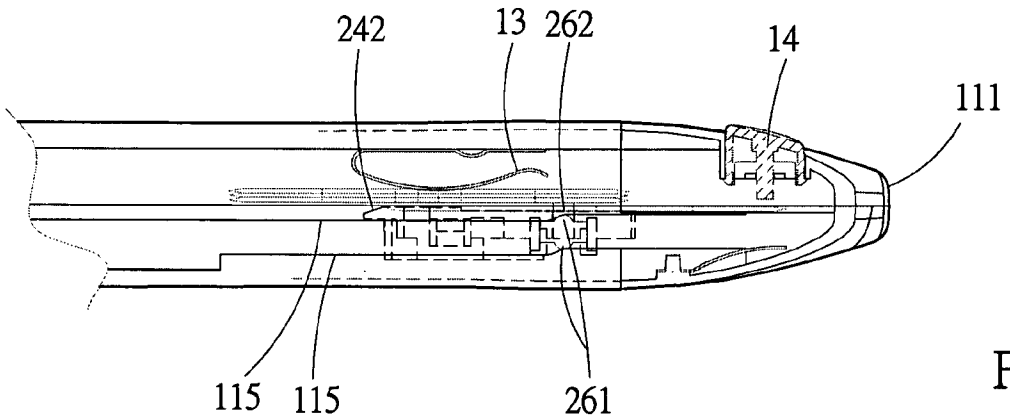
FIG. 12B is a top sectional view taken along line II—II of FIG. 12A, showing that the pushing mechanism of the present invention is positioned between the first and second positions.
Figure 13A:
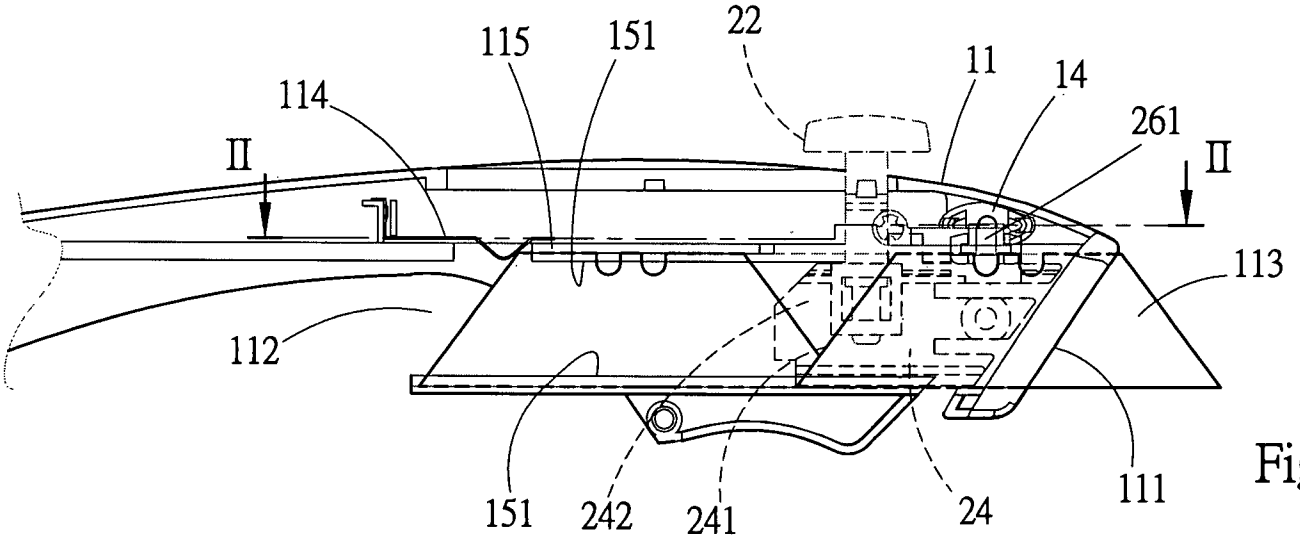
FIG. 13A is a front assembled view according to FIG. 5.
Figure 13B:
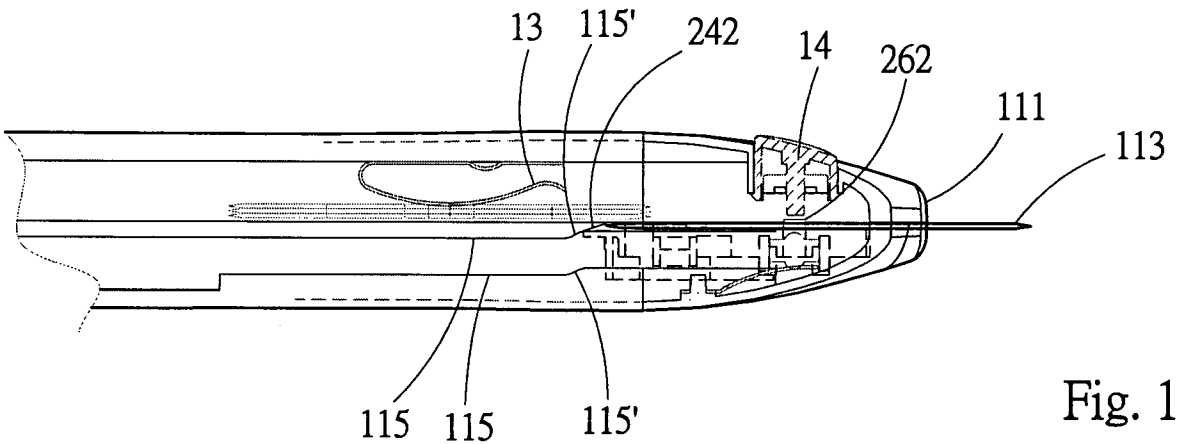
FIG. 13B is a top sectional view taken along line II—II of FIG. 13A, showing that the pushing mechanism of the present invention is positioned in the second position.

According to the above arrangement, the utility knife of the present invention has the following advantages:

1. Referring to FIG. 5, the overlapping blades are loaded into the housing from the opening of the rear end 112 by way of insertion. A user can conveniently, easily and safely pinch the blades with fingers. This meets the requirement of engineering of human body.
2. Referring to FIGS. 8 and 9, the receptacle section 15 for accommodating the blades 113 is formed of two channels 151 having a certain length in the lengthwise direction of the housing 11. The channels 151 are spaced from each other by a certain distance and fixedly disposed in the housing 11. The receptacle section 15 has a form of a cartridge. This is different from the conventional structure on which the blades are hung. Therefore, the blade can be more smoothly pushed and more reliably used.
3. The bent section 115' of the guide rail 115 serves to guide and displace the slide block 26. After the slide block 26 moves forward toward the front end 111 and passes through the bent section 115', the slide block 26 is biased to make the insertion section 262 inserted in the notched section 113' by a larger depth which is even larger than the thickness of one blade 113. This makes the slide block 26 more firmly engaged with the blade so that the utility knife can be more reliably used.
4. The slide block 26 is slidably engaged with the blade. Such simple structure and component can easily truly engage with the blade. In contrast, the conventional structure employs small springs which can hardly achieve reliable engagement.
5. The present invention can be easily and firmly assembled to lower the manufacturing cost. Especially, the slide block 26 is firmly assembled with the moving section 24 by way of insertion.

In the above structure of the present invention, the pushing mechanism 12 further includes a first abutting section 241 and a second abutting section 242.

The first abutting section 241 extends from the moving section 24 toward the rear end 112 and the blades 113 by a certain length. The first abutting section 241 abuts against the rear edge of a blade closest to the first abutting section 241 to aid the moving section 24 in pushing and driving the blade.

The second abutting section 242 extends from the first abutting section 241 toward the rear end 112 by a certain length. When the pushing mechanism 12 is positioned in the second position, the second abutting section 242 serves to abut against one side of a blade next to the driven blade. Therefore, the pushing mechanism 12 can be moved back to the first position without obstruction.

The above embodiments are only used to illustrate the present invention, not intended to limit the scope thereof. Many modifications of the above embodiments can be made without departing from the spirit of the present invention.

What is claimed is:

1. A knife comprising:

a handheld housing having a front end and a rear end, the housing serving to accommodate several blades therein, each blade having a notched section, the front end having an opening;

a slidable pushing mechanism disposed on the housing and including an activating section and a moving section, the activating section outward protruding from the housing and being manually movable between the front end and the rear end, the activating section being manually engageable with the housing, whereby the pushing mechanism can be fixed in a first position or a second position of the housing, the moving section being connected with the activating section and positioned inside the housing, whereby when the pushing mechanism is positioned in the first position, the moving section is adjacent to the blades for engaging with the notched section and pushing one of the blades to the second position and protruding the blade from the front end through the opening thereof;

a resilient section disposed on inner side of the housing, whereby when the pushing mechanism is positioned in the first position, the resilient section serves to transversely push the blades toward the moving section; and a releasing mechanism transversely reciprocally movably disposed on the housing, when the pushing mechanism is positioned in the second position, the releasing mechanism serving to push the moving section to release the blade from the moving section, whereby the blade can be pulled out from the opening of the front end, said knife being characterized in that a pair of guide rails spaced from each other by a certain distance are disposed in the housing between the front end and the rear end, a slide block being disposed on the moving section;

each guide rail has a transverse bent section between the first and second positions of the housing, the bent section being obliquely bent toward the resilient section;

the slide block is transversely slidably disposed on the moving section and positioned between the guide rails, the slide block having a sliding section and an insertion section;

the sliding section is disposed on two opposite sides of the slide block for abutting against the guide rails, whereby after the slide block passes through the bent section, the slide block is displaced in a transverse direction of the housing; and the insertion section is disposed on the slide block corresponding to the notched section, whereby when the slide block is displaced, the insertion section is inserted into the notched section by different depths for engaging with one of the blades.

2. The knife as claimed in claim 1, wherein the pushing mechanism further includes a first abutting section and a second abutting section, the first abutting section extending from the moving section toward the rear end and the blades by a certain length, the first abutting section abutting against a rear edge of a blade closest to the first abutting section to aid the moving section in pushing and driving the blade, the second abutting section extending from the first abutting section toward the rear end by a certain length, whereby when the pushing mechanism is positioned in the second position, the second abutting section serves to abut against one side of a blade next to the driven blade so as to move the pushing mechanism back to the first position without obstruction.

* * * * *